US006092505A

United States Patent [19]

Takahashi et al.

[11] Patent Number: 6,092,505

[45] Date of Patent: Jul. 25, 2000

[54] ENGINE CONTROLLING APPARATUS FOR AN AUTOMOTIVE ENGINE

[75] Inventors: Tatsuhiko Takahashi, Hyogo; Shiro Yonezawa, Tokyo; Satoshi Wachi, Tokyo; Atsuko Hashimoto, Tokyo; Hirofumi Ohuchi, Tokyo, all of Japan

[73] Assignee: Mitsubishi Denki Kabushiki Kaisha, Tokyo, Japan

[21] Appl. No.: 09/047,462

[22] Filed: Mar. 25, 1998

[30] Foreign Application Priority Data

Dec. 1, 1997 [JP] Japan ..... 9-330547

[51] Int. Cl.[7] ..... F02D 7/00; F02D 41/00

[52] U.S. Cl. ..... 123/399; 123/339.23

[58] Field of Search ..... 123/399, 361, 123/396, 481, 339.15, 339.23, 198 F

[56] References Cited

U.S. PATENT DOCUMENTS

| | | | |
|---|---|---|---|
| 4,506,639 | 3/1985 | Murakami et al. | 123/339 |
| 5,092,420 | 3/1992 | Sugawara et al. | 123/197 |
| 5,343,840 | 9/1994 | Wataya et al. | 123/399 |
| 5,452,697 | 9/1995 | Sasaki et al. | 123/399 |
| 5,927,250 | 7/1999 | Nishida | 123/399 |

*Primary Examiner*—Henry C. Yuen
*Assistant Examiner*—Mahmoud M Gimie
*Attorney, Agent, or Firm*—Sughrue, Mion, Zinn, Macpeak & Seas, PLLC

[57] ABSTRACT

An engine controlling apparatus is provided in which a stable limp-home drive is possible even if an open breakdown of a throttle valve occurs. The apparatus includes a throttle breakdown detecting unit S1 for detecting the breakdown in a throttle controlling system including the throttle valve and a throttle opening degree sensor, a throttle power source interrupting unit S2 for interrupting a power source supply to a throttle actuator in the case where the breakdown in the throttle controlling system is detected, and a predetermined operational condition detecting unit S3 for detecting a shift of the operational condition to a predetermined operational condition corresponding to a fully closed condition of the throttle valve in operation of the throttle power source interrupting unit. A bypass controlling unit S4 opens the bypass valve to feed the air to the engine at the time when the predetermined operational condition is detected in operation of the throttle power source interrupting unit.

14 Claims, 6 Drawing Sheets

ENGINE CONTROLLING APPARATUS FOR AN AUTOMOTIVE ENGINE

BACKGROUND OF THE INVENTION

1. Field of the Invention

The present invention relates to an engine controlling apparatus for an automotive vehicle, which may take a fail-safe in a limp-home operation in the case where a throttle controlling system is broken down, and more particularly to an engine controlling apparatus for an automotive vehicle, which may take a safety limp-home operation even if not only a throttle opening degree sensor but also a throttle valve would be broken down.

2. Description of the Related Art

FIG. 5 is a block diagram showing a structure of a conventional engine controlling apparatus for an automotive vehicle disclosed in, for example, Japanese Patent Application Laid-Open No. Hei 5-312079.

In FIG. 5, an engine 1 mounted on the automotive vehicle is composed of a plurality of cylinders and provided with an intake pipe 2 and an exhaust pipe (not shown).

An air flow sensor (AFS) 3 is provided upstream of the intake pipe 2 for detecting an amount of air to be fed to the engine 1 to thereby output an intake air amount signal Qa.

A throttle valve 4 is provided within the intake pipe 2 to be openable/closable for adjusting the intake air amount Qa.

A motor 5 provided on a rotary shaft of the throttle valve 4 constitutes a throttle actuator for opening/closing the throttle valve 4. The throttle valve 4 is connected directly to the rotary shaft of the motor 5 or through a gear (not shown) to the rotary shaft thereof.

A throttle opening degree sensor (TPS) 6 detects an opening degree of the throttle valve 4 to output a throttle opening signal T.

A bypass passage 7 is provided at a part of an intake pipe 2 to bypass between the upstream side and the downstream side of the throttle valve 4.

A bypass valve 8 adjusts an opening degree of the bypass passage 7 for controlling a bypass air amount for, for example, a limp-home control.

An accelerator pedal 9 is operated by a driver. An accelerator opening degree sensor (APS) 10 detects an opening degree of the accelerator pedal 9 to output an accelerator opening degree signal A.

The AFS 3, the TPS and APS 10 constitute a variety of sensors for detecting the operational condition of the engine 1 together with other sensors (not shown) such as a crank angle sensor and a vehicle velocity sensor.

A first ECU 11 composed of a microcomputer outputs control signals for driving various actuators on the basis of the operational condition information signals from the variety of sensors.

The first ECU 11 is provided with an engine controlling means for controlling the engine 1 in accordance with the operational condition and a bypass controlling means for controlling the bypass valve 8.

Also, the first ECU 11 is provided with a throttle breakdown detecting means for detecting a breakdown of a throttle controlling system including the throttle valve 4 and the TPS 6, a throttle power source interrupting means for interrupting the power source supply to the motor 5 in the case where the breakdown is detected in the throttle controlling system, and a predetermined operational condition detecting means for detecting that the operational condition has been shifted to a predetermined operational condition corresponding to the fully closed condition of the throttle valve 4 when the throttle power source interrupting means is in operation.

In this case, only the bypass drive signal D for the bypass valve 8 is shown. However, an injection signal for an injector (not shown) within the engine 1, an ignition signal for an ignition plug (not shown) and the like are included in the control signals to be outputted from the first ECU 11.

Also, a second ECU 12 composed of a microcomputer which cooperates with the first ECU 11 through bidirectional communication lines L and is provided with a throttle controlling means for electrically controlling the motor 5 in response to the accelerator opening degree signal A to thereby output a motor drive signal M.

A battery 13 performs a power supply to each ECU 11, 12 through a main relay 14 and at the same time performs a power supply to the second ECU 12 through a motor controlling relay 15 driven under the control of the main relay 14.

The operation of the conventional engine controlling apparatus for the automotive vehicle shown in FIG. 5 will now be described with reference to a timing chart shown in FIG. 6.

First of all, in a normal operational condition, the engine controlling means within the first ECU 11 calculates control parameters for the engine 1 to perform the fuel injection and the ignition control in response to the operational condition.

The bypass controlling means and the throttle power source interrupting means within the first ECU 11 control the bypass valve 8 of the bypass passage 7 by exchanging the information in cooperation with the second ECU 12 through the communication lines L, and at the same time, control the motor controlling relay 15 that functions as the power source interrupting means.

On the other hand, the throttle controlling means within the second ECU 12 outputs a motor drive signal M in response to the accelerator opening degree A to control the throttle opening degree to a target opening degree To (indicated by one-dot line in FIG. 6).

Namely, the throttle controlling means calculates the target opening degree To of the throttle valve 4 on the basis of the accelerator opening degree A from the APS 10 and the information obtained from the first ECU 11 through the communication lines L to control the motor 5 by the motor drive signal M to adjust the opening degree of the throttle valve 4.

At this time, the throttle controlling means performs the power supply to the motor 5 through the motor controlling relay 15 to perform the feedback control of the throttle opening degree in response to the accelerator opening degree signal A.

In other words, the opening degree deviation between the throttle opening degree signal T and the target opening degree To that is varied in response to the opening degree of the throttle valve 4 is taken to perform the control such that the opening degree deviation becomes zero (T=To).

The operation for shifting to the bypass control in the case where any breakdown occurs in a structural component of the throttle controlling system and the bypass valve 8 of the bypass passage 7 is controlled for the limp-home operation will now be described.

In this case, the case where an earth-short breakdown occurs in the TPS 6 is exemplified.

For example, at time t1, when the earth-short breakdown occurs in the TPS 6 and the throttle opening degree signal T is fixed to zero [V], it is impossible to perform the feedback control of the throttle valve 4 to the target opening degree To. As a result, the program is shifted to the bypass control condition through the bypass passage 7 as the fail-safe function of the vehicle operation.

At this time, the throttle breakdown detecting means within the first ECU 11 drives a timer from the time t1 when the throttle opening degree signal T exhibits a level equal to or less than a predetermined opening degree Tr corresponding to the earth-short level (ground level=0 V). A breakdown flag F is turned on at time t2 after a predetermined time tf has lapsed.

Incidentally, if the breakdown flag F is on immediately after time t1 when the throttle opening degree signal T exhibits 0 V, there is a possibility that the breakdown would be misjudged in the case where there would be the affect of noises or the like. Accordingly, in the case where the condition equal to or less than the predetermined lower limit is continued for the predetermined time period tf, the breakdown flag F is on (i.e., the breakdown judgement).

Thus, the throttle power source interrupting means within the first ECU 11 interrupts the magnetic excitation of the motor controlling relay 15 at the on-time t2 of the breakdown flag F and interrupts the power supply from the second ECU 12 to the motor 5.

Accordingly, there is no torque generated by the motor 5. As a result, the throttle valve 4 is kept at the fully closed condition by a return spring (not shown) provided on the rotary shaft.

Also, the bypass controlling means within the first ECU 11 turns on the bypass drive signal D and opens the bypass valve 8 to feed the bypass intake air amount through the bypass passage 7 to the engine 1.

Accordingly, under the condition that the throttle valve 4 by which the feedback control is disabled is fully closed, the engine 1 is driven with the minimum possible operational ability by the intake air amount through the bypass passage 7 so that the vehicle may be driven in the limp-home mode to the service station.

Incidentally, the breakdown of the motor 5 in the throttle controlling system is detected by, for example, the deviation between the target opening degree To and the actual throttle opening (throttle opening degree signal T), or the relationship between the intake air amount signal Qa and the target opening degree To. In this case, in case of the detection of the breakdown of the motor 5, the opening degree control of the bypass valve 8 in response to the accelerator opening degree signal A is controlled.

Thus, the conventional vehicle engine controlling apparatus interrupts the power supply to the motor 5 in response to the on-operation of the breakdown flag F in the case where the breakdown is detected in the throttle controlling system, and at the same time, performs the limp-home control of the vehicle.

If the breakdown is the simple earth-short breakdown of the TPS 6, there is no problem. However, it is impossible to confirm the condition of the throttle valve 4 (i.e., whether or not the throttle valve 4 is actually fully closed even if the drive of the motor 5 is stopped). Accordingly, the conventional apparatus suffers from the following defect.

For instance, if there is an opening fixed condition (open breakdown) in which the throttle valve 4 is not fully closed even if the drive of the motor 5 is stopped, and if the bypass valve 8 is opened in response to the on-operation of the breakdown flag F, the intake air amount to be fed to the engine 1 is excessive, resulting in difficulty in decelerating or stopping the vehicle.

As described above, according to the conventional vehicle engine controlling apparatus, since the bypass passage 7 is opened irrespective of the breakdown condition in detecting the breakdown of the throttle controlling system, the conventional vehicle suffers from a problem that it is difficult to decelerate or stop the vehicle in case of the open breakdown of the throttle valve 4.

SUMMARY OF THE INVENTION

In view of the foregoing problem, it is an object of the invention to provide an engine controlling apparatus for an automotive vehicle that may perform a stable limp-home drive even if an open breakdown occurs in a throttle valve.

According to the invention, there is provided an engine controlling apparatus for an automotive vehicle, comprising: an engine mounted on the vehicle and composed of a plurality of cylinders; a variety of sensors for detecting an operational condition of the engine; an engine controlling means for controlling the engine in response to the operational condition; a throttle valve for adjusting an amount of intake air to be fed to the engine; a throttle actuator for driving the throttle valve; a throttle opening degree sensor for detecting an open/closed position of the throttle valve as a throttle opening degree; a bypass passage for feeding air to the engine through a bypass around the throttle valve; a bypass valve for opening/closing the bypass passage; a bypass controlling means for controlling the bypass valve; an accelerator opening degree sensor for detecting an operational position of an accelerator pedal as an accelerator opening degree; a throttle controlling means for controlling the throttle actuator in response to the accelerator opening degree; a breakdown detecting means for detecting a breakdown in a throttle controlling system including the throttle valve and the throttle opening degree sensor; a throttle power source interrupting means for interrupting a power source supply to the throttle actuator in the case where the breakdown in the throttle controlling system is detected; and a predetermined operational condition detecting means for detecting a shift of the operational condition to a predetermined operational condition corresponding to a fully closed condition of the throttle valve in operation of the throttle power source interrupting means; in which the bypass controlling means opens the bypass valve to thereby feed the air to the engine at the time when the predetermined operational condition is detected in operation of the throttle power source interrupting means.

Also, the engine controlling apparatus for the automotive vehicle according to the invention further comprises an engine stall detecting means for detecting a stall condition of the engine and the bypass controlling means opens the bypass passage in the case where the engine is at a standstill in operation of the throttle power source interrupting means.

Also, in the automotive engine controlling apparatus according to the invention, the engine controlling means comprises a fuel interrupting means for interrupting a fuel supply to at least one of the cylinders of the engine in operation of the throttle power source interrupting means.

Also, in the automotive engine controlling apparatus according to the invention, the fuel interrupting means changes the number of the cylinders to which the fuel supply is stopped in response to the accelerator opening degree.

Also, in the automotive engine controlling apparatus according to the invention, the variety of sensors include an RPM sensor for detecting an RPM of the engine; and the fuel interrupting means changes the number of the cylinders to which the fuel supply is stopped in response to the engine RPM.

Also, in the automotive engine controlling apparatus according to the invention, the fuel interrupting means sets a first predetermined level corresponding to the accelerator opening degree as a judgement reference of the number of the cylinders to which the fuel supply is stopped and a second predetermined level that is higher than the first predetermined level; stops the fuel supply corresponding to the two cylinders in the case where the accelerator opening degree is smaller than the first predetermined level; stops the fuel supply to the one cylinder in the case where the accelerator opening degree is equal to or more than the first predetermined level and smaller than the second predetermined level; and does not stop the fuel supply corresponding to all the cylinders in the case where the accelerator opening degree is higher than the second predetermined level.

Also, in the automotive engine controlling apparatus according to the invention, the fuel interrupting means sets a third predetermined level that is smaller than the first predetermined level as a judgement reference of the number of the cylinders to which the fuel supply is stopped and a fourth predetermined level that is intermediate between the first predetermined level and the second predetermined level; performs alternatively a stop control of the fuel supply and a non-stop control of the fuel supply to one cylinder at every fuel supply timing in the case where the accelerator opening degree is equal to or more than the fourth predetermined level and smaller than the second predetermined level; and performs alternatively the stop control of the fuel supply to one cylinder and a stop control of the fuel supply to the two cylinders at every fuel supply timing in the case where the accelerator opening degree is equal to or more than the third predetermined level and smaller than the first predetermined level.

Also, in the automotive engine controlling apparatus according to the invention, the bypass valve is composed of an on/off valve.

Also, in the automotive engine controlling apparatus according to the invention, the bypass valve is composed of a linear solenoid valve and is duty driven in response to the accelerator opening degree in operation of the throttle power source interrupting means.

Also, in the automotive engine controlling apparatus according to the invention, the predetermined operational condition detecting means sets variably a condition for detecting a shift to the predetermined operational condition in response to the operational condition in detecting the breakdown in the throttle controlling system.

Also, in the automotive engine controlling apparatus according to the invention, the variety of sensors include an air flow sensor for detecting the amount of intake air; and the predetermined operational condition detecting means detects the predetermined operational condition when the amount of intake air is equal to or less than a predetermined level for detecting the fully closed condition of the throttle valve.

Also, in the automotive engine controlling apparatus according to the invention, the variety of sensors include an air flow sensor for detecting the amount of intake air, and the predetermined operational condition detecting means detects the predetermined operational condition when a reduction rate of the amount of intake air is equal to or less than a predetermined level for detecting the fully closed condition of the throttle valve.

Also, in the automotive engine controlling apparatus according to the invention, the variety of sensors include at least one of a vehicle velocity sensor for detecting a vehicle velocity of the vehicle, an RPM sensor for detecting an RPM of the engine, and a pressure sensor for detecting a pressure within the intake pipe of the engine; and the predetermined operational condition detecting means detects the predetermined operational condition when at least one of the vehicle velocity, the RPM and the pressure is equal to or less than a predetermined level for detecting the fully closed condition of the throttle valve.

DESCRIPTION OF THE PREFERRED EMBODIMENTS

Embodiment 1

A first embodiment of the present invention will now be described with reference to FIG. 1.

Figure 5:
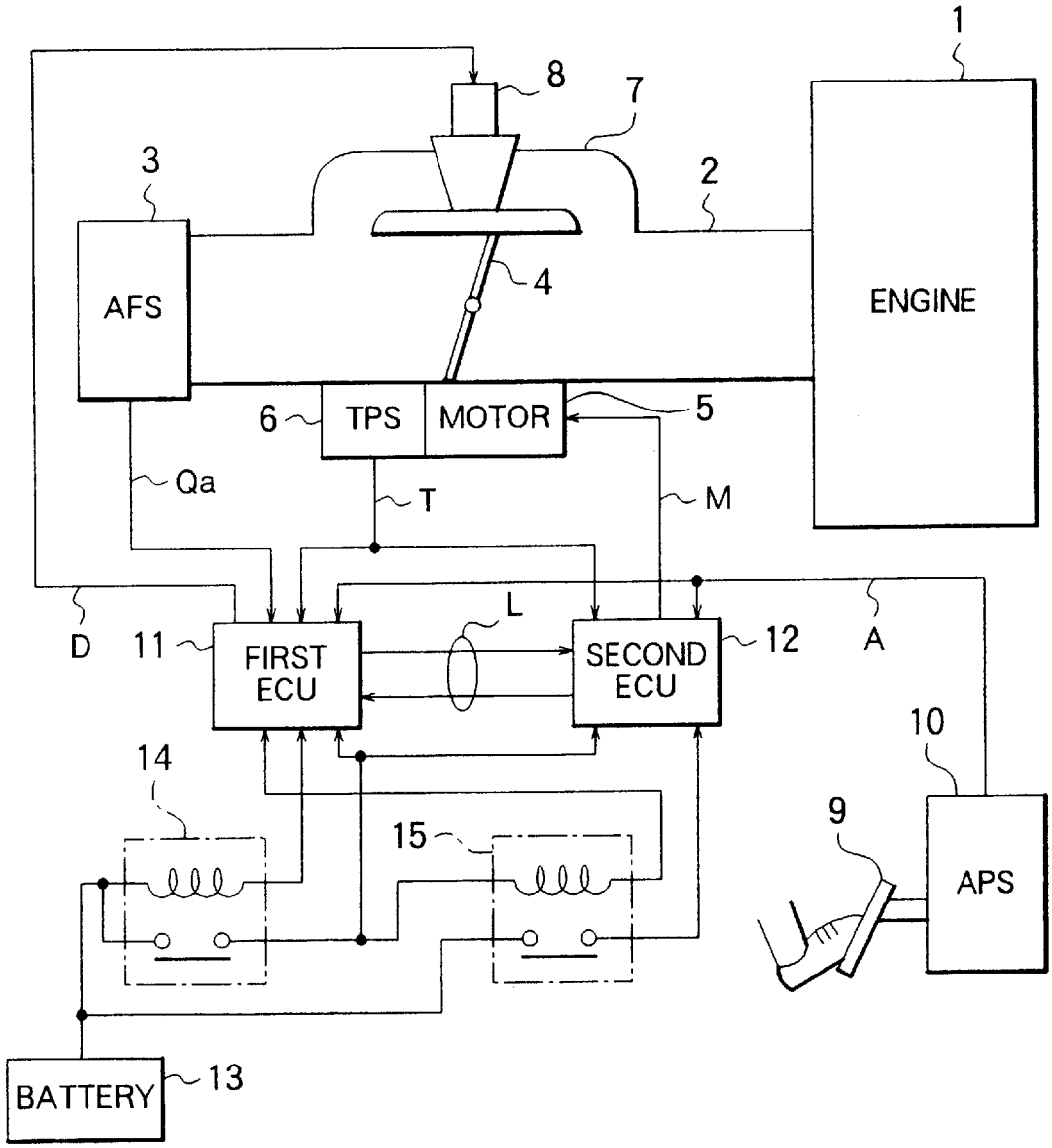
FIG. 5 is a structural view showing a conventional engine control apparatus for an automotive vehicle.
Figure 6:
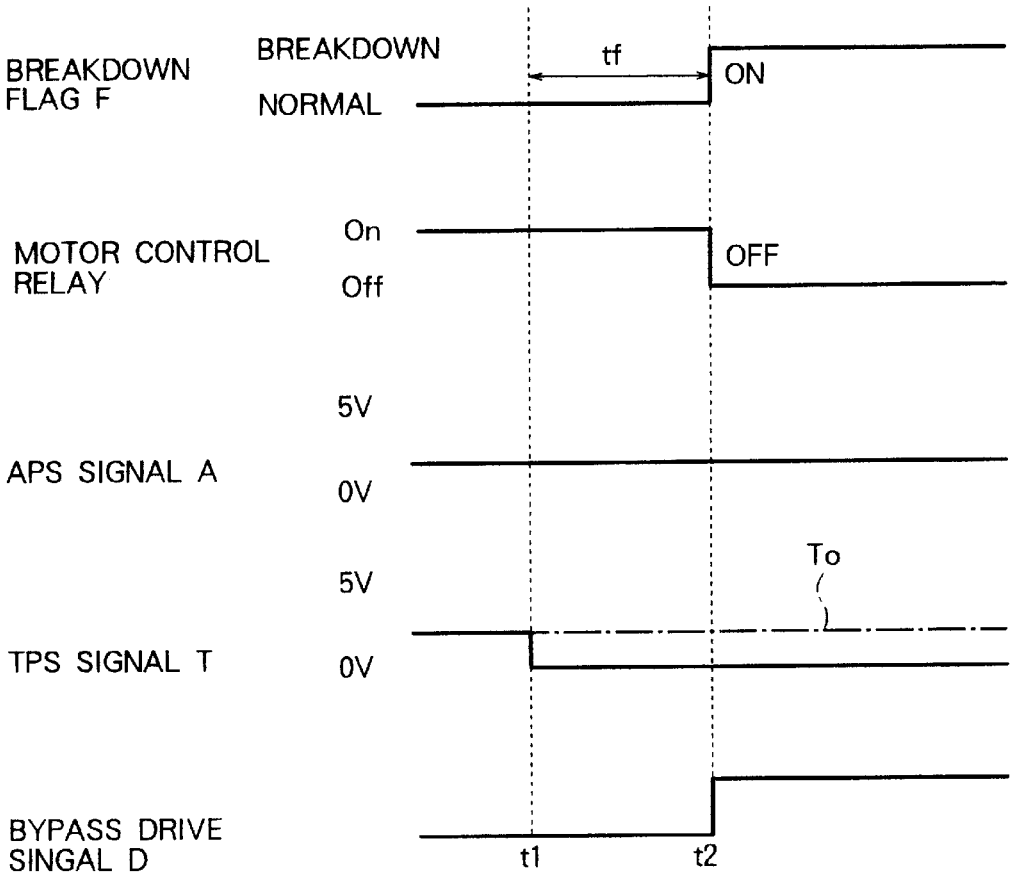
FIG. 6 is a timing chart for illustrating the operation in the case where an accelerator opening degree sensor of a conventional engine control apparatus for an automotive vehicle is broken down in the earth-short circuit.

The structure of the first embodiment of the invention is the same as that shown in FIG. 5. There is only a distinction between the embodiment and the example shown in FIG. 5 in part of the operation processing program within the first and second ECUs 11 and 12.

In this case, the first ECU 11 is provided with a predetermined operation condition detecting means for detecting that the operational condition has been shifted to a predetermined operational condition corresponding to the fully closed condition of the throttle valve 4 in the operation of the throttle power source interrupting means.

For example, the predetermined operational condition detecting means detects the shift to the predetermined operational condition when the intake air amount signal Qa is equal to or less than any predetermined amount Qr for detecting the fully closed condition of the throttle valve 4. Needless to say, the predetermined amount Qr is set at a level which is somewhat higher than an intake air amount corresponding to the fully closed condition.

Also, the bypass controlling means within the first ECU 11 is adapted to open the bypass valve 8 to feed the air to the engine 1 at the time when the predetermined operational condition is detected in the operation of the throttle power source interrupting means.

Namely, the bypass controlling means determines whether or not the bypass valve 8 should be opened, on the basis of the control information of the engine 1, in the case where the breakdown which should be dealt with by the bypass control would occur, after the motor controlling relay 15 is turned off and the power supply to the motor 5 is interrupted. Then, the bypass control is effected only in the case of the exhibition of the predetermined operational condition.

The operation of the first embodiment of the invention will now be described with reference to FIGS. 1 and 2 as well as FIG. 5.

The normal control operation is the same as described above. Accordingly, the explanation therefor will be omitted.

Figure 1:
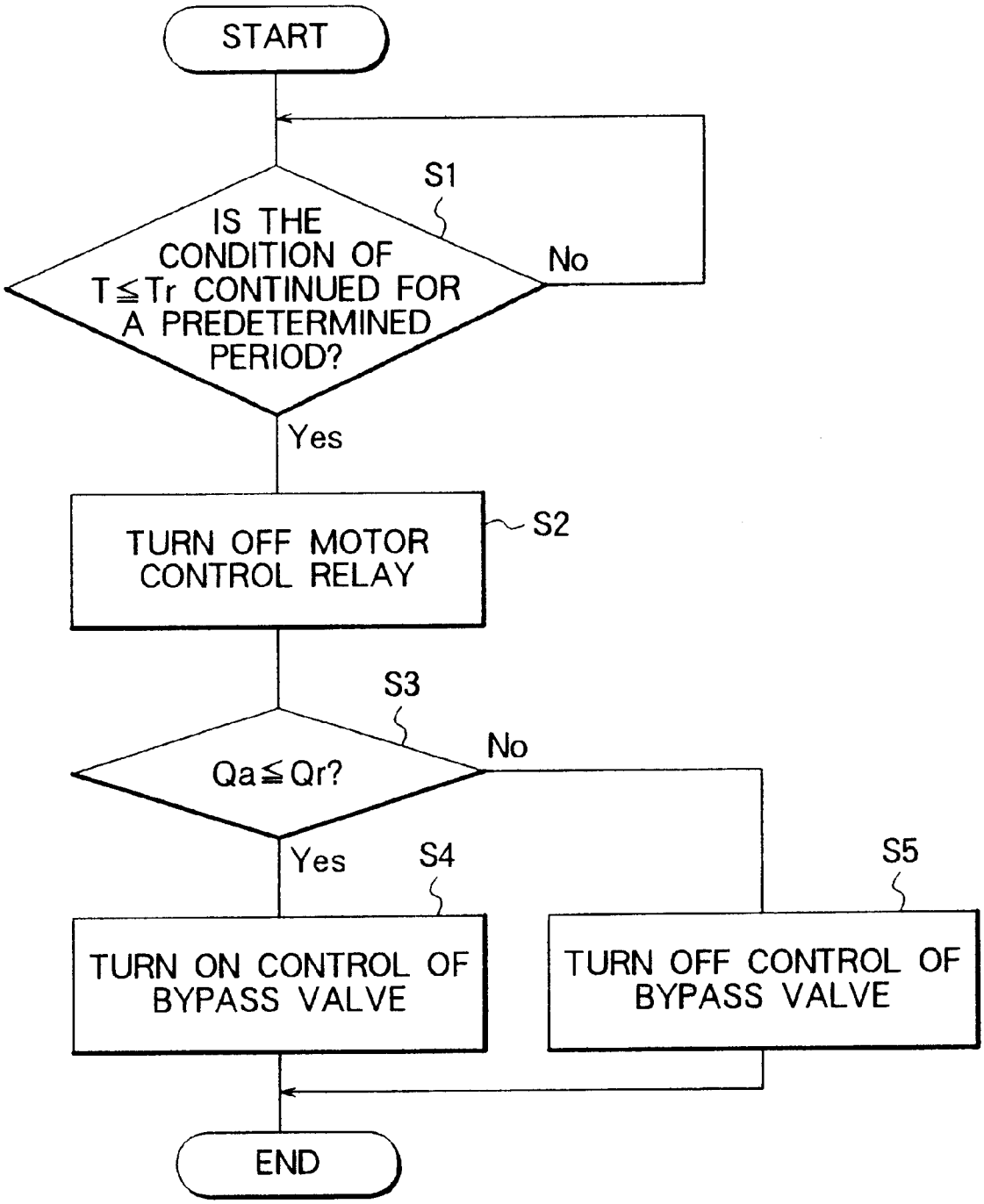
FIG. 1 is a flowchart showing a shift operation to a bypass control in accordance with a first embodiment of the present invention.

FIG. 1 is a flowchart showing the shift operation to the bypass control in accordance with the first embodiment of the invention. FIG. 2 is a timing chart for illustrating the operation in the case where the TPS 6 is earth-short breakdown.

In FIG. 1, first of all, the throttle breakdown detecting means determines whether or not the voltage level of the throttle opening degree signal T is equal to or less than the predetermined opening degree Tr, and determines whether or not the condition of $T \leqq Tr$ is continued for a predetermined time period tf from a starting point of time t1 when the condition of $T \leqq Tr$ is judged (step S1).

If it is determined that the condition of $T \leqq Tr$ is continued for the predetermined time period tf (namely, YES), the throttle breakdown determining means turns on the breakdown flag F at time t2.

Also, if the TPS 6 is earth-short circuited, the throttle controlling means in the first ECU 11 cannot perform the feedback control of the throttle opening degree to the target opening degree To. Accordingly, at time t2, the throttle power source interrupting means turns off the motor controlling relay 15 and interrupts the power supply to the motor 5 (step S2).

In the case where the TPS 6 is thus earth-short circuited, the voltage level of the throttle opening degree signal T exhibits 0 V (corresponding to the level equal to or lower than the fully closed opening degree of the lower limit). Accordingly, the earth-short breakdown of the signal level that is not outputted in the normal condition is detected. It is possible to turn the throttle power source off.

Inversely, in the case where the voltage level of the throttle opening degree signal T exhibits the power source level (corresponding to the level equal to or higher than the fully opened degree of the upper limit) which could not be outputted in the normal condition, it is possible to top-short circuited breakdown of the TPS 6.

As in step S2, if the power supply to the motor 5 is interrupted at time t2, the throttle valve 4 is returned back to the fully closed condition, so that the intake air amount signal Qa is decreased to reduce the output of the engine 1. Accordingly, it is impossible to control the throttle opening degree in response to the accelerator opening degree signal A and it is impossible to perform the normal drive.

Therefore, in order to enable the limp-home drive avoiding the standstill condition, it is necessary to perform the intake air amount control by the above-described bypass valve 8 after the motor controlling relay 15 is turned off.

However, only with the condition that the breakdown flag F is turned on, the first ECU 11 cannot judge whether the breakdown is the breakdown of the TPS 6 or the throttle valve 4.

For instance, in the case where the throttle valve 4 is broken down in the open condition, even if the power supply to the motor 5 is interrupted, the throttle valve 4 is not fully closed. Accordingly, the bypass valve 8 is opened (on), as described above, there is a possibility the intake air amount is excessive.

Accordingly, the predetermined operational condition detecting means in the first ECU 11 determines whether or not the intake air amount Qa is equal to or less than the predetermined amount Qr (the fully closed condition detecting amount of the throttle valve 4) (the predetermined operational condition or not) (step S3).

If it is judged that the condition of $Qa \leqq Qr$ is established, it is known that the throttle valve 4 is normal but closed by interrupting the power source supply to the motor 5. The bypass drive signal D is turned on and the bypass control by the bypass valve 8 is turned on (step S4). The process routine shown in FIG. 1 is finished.

Figure 2:
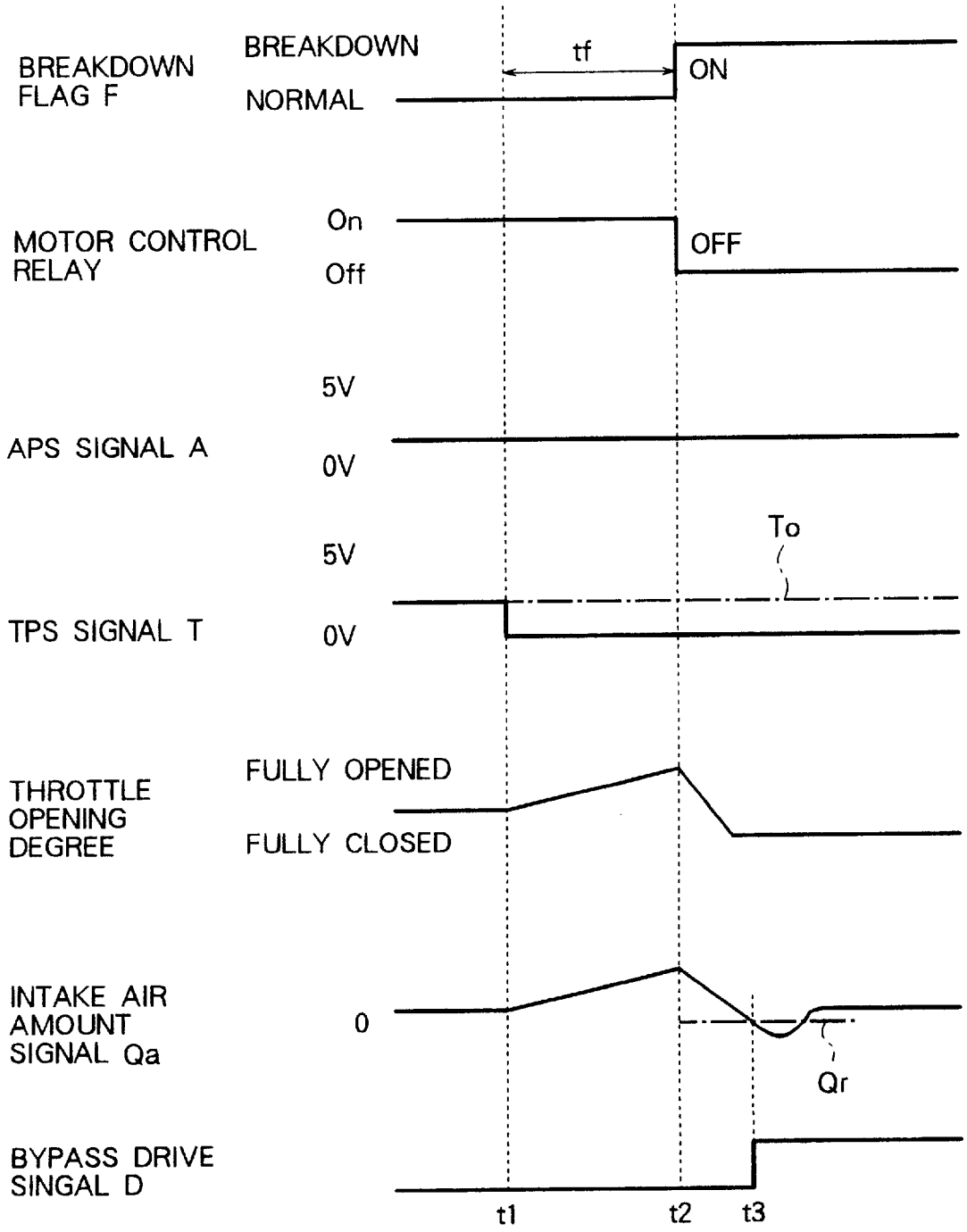
FIG. 2 is a timing chart for illustrating the operation in the case where an accelerator opening degree sensor is earth-short circuited in the first embodiment.

In FIG. 2, at time t3, the condition of $Qa \leqq Qr$ is established, and the bypass drive signal D is turned on.

Thus, the shift to the bypass control is effected at the time when the intake air amount signal Qa which is the engine control information is equal to or less than the predetermined amount Qr so that the engine 1 is driven by the intake air amount through the bypass passage 7. It is therefore possible to perform the limp-home drive.

On the other hand, in step S3, it is determined that the intake air amount signal Qa is not reduced to the level equal to or less than the predetermined amount Qr (namely, NO), there is a fear that the throttle valve 4 would be broken down in the open condition. Accordingly, while maintaining the off-condition of the bypass drive signal D, the control of the bypass valve 8 is turned off (step S5). Then, the process routine shown in FIG. 1 is finished.

Also, needless to say, in the case where the bypass control is turned off as in step S5, it is possible to perform the limp-home drive by the intake air amount through the throttle valve 4 kept in the open-breakdown condition.

In this embodiment, the case in which the throttle valve opening degree signal T exhibits the level equal to or less than the earth-short breakdown level has been described above. However, also in the case where the throttle opening degree signal T exhibits the level more than the top-short breakdown level, the shift to the bypass control is performed at the time when the intake air amount signal Q3 is lowered to the level equal to or less than the predetermined amount from the on-time of the breakdown flag F in the same manner.

Accordingly, even in the breakdown detection, it is possible to decelerate or stop the vehicle without opening the bypass valve 8 until it is confirmed that the throttle valve 4 is fully closed by interrupting the power source supply to the motor 5.

Embodiment 2

Incidentally, in the first embodiment, as the shift condition to the bypass control (condition for detecting the shift to the predetermined operational condition), in step S3, it is determined whether or not the voltage level of the intake air amount signal Qa is equal to or less than the predetermined amount Qr. It is however possible to determine whether or not the reduction change rate of the voltage level of the intake air amount signal Qa exhibits the predetermined change rate or more.

In this case, in the shift to the bypass control, the deviation occurs at the level equal to or more than the predetermined amount in the intake air amount signal Qa after the motor controlling relay 15 is turned off, and the bypass valve 8 is opened when the amount of deviation corresponds to the fully closed condition of the throttle valve 4. It is therefore possible to decelerate or stop the vehicle in the same manner as described above.

Embodiment 3

Incidentally, in the second embodiment, the stall condition of the engine 1 is not particularly considered in the judgement of the shift condition to the bypass control. However, the intake air amount deviation above the predetermined amount is not generated depending upon the operational condition before the occurrence of the breakdown. Accordingly, there is a fear that the engine is stalled before the reduction change rate of the intake air amount signal Qa exhibits the predetermined amount or more (the shift to the bypass control).

Accordingly, in the case where the engine stall condition has been detected before the shift to the bypass control, the bypass valve 8 is opened immediately to restart the engine and to enable the limp-home drive.

The third embodiment of the invention in which the engine 1 is restarted in the engine stall will now be described with reference to FIG. 3.

Incidentally, the structure of the third embodiment of the invention is the same as that shown in FIG. 5. There is only a distinction between this embodiment and the example shown in FIG. 5 in part of the operation processing program within the first ECU 11.

In this case, the first ECU 11 is provided with an engine stall detecting means for detecting the stall condition of the engine 1. The bypass controlling means in the first ECU 11 is adapted to turn on the bypass valve 8 referring to an engine stall determination flag E of the engine stall detecting means.

Figure 3:
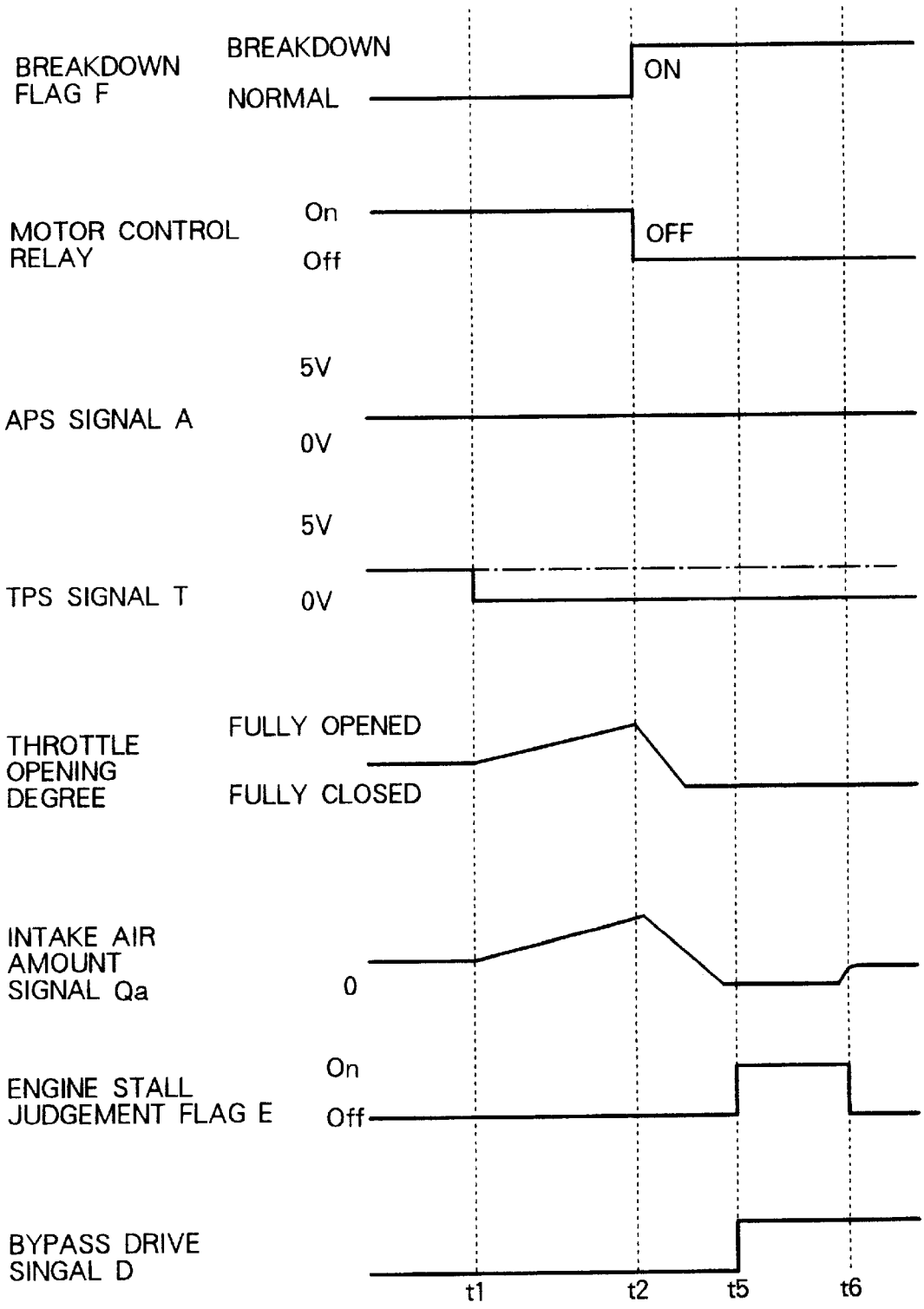
FIG. 3 is a timing chart for illustrating the bypass control operation in accordance with a third embodiment of the invention.

FIG. 3 is a timing chart showing a bypass controlling operation according to the third embodiment of the invention.

In FIG. 3, the intake air amount signal Qa is reduced by turning off the motor controlling relay 15. However, in the case where the reduction rate of the intake air amount signal Qa is continuously reduced while keeping the condition that the reduction rate is lower than a predetermined change rate, the engine is stalled without detecting the predetermined operational condition.

At this time, the engine stall detecting means turns on the engine stall determination flag E on the basis of the engine RPM or velocity at time t5 when the engine RPM or velocity exhibits the standstill level.

Accordingly, the bypass controlling means turns on the bypass drive signal D at time t5 in response to the turn-on of the engine stall determination flag E.

Thus, since the bypass valve 8 is turned on to thereby open the bypass passage 7 immediately after the engine stall generation, the engine 1 is restarted at time t6 and the vehicle is restored back to the condition that the vehicle may be driven in the limp-home mode.

When the engine 1 is restarted, the engine stall flag E is turned off.

Embodiment 4

Incidentally, in the third embodiment, the case where the intake air amount deviation equal to or more than the predetermined amount is detected as the shift condition to the bypass control has been described. However, as described above (in the first embodiment), also in the case where the intake air amount equal to or less than the predetermined amount is detected, depending upon the operational condition before the generation of the breakdown, there is a possibility that the engine stall would occur before the shift to the bypass control.

Accordingly, irrespective of the shift condition to the bypass control, it is effective to perform the open control of the bypass valve 8 in the engine stall detection. Needless to say, the same effect is ensured.

Embodiment 5

Incidentally, in the foregoing embodiments 1 to 4, the improvement in the drivability in the limp-home mode after the shift to the bypass control is not particularly considered. It is however possible to reduce the output torque of the engine to improve the limp-home drivability by selectively interrupting the fuel supply to each cylinder of the engine 1.

Also, it is possible to change over the output torque of the engine 1 in the limp-home drive to a plurality of stages in response to the accelerator opening degree signal A.

A fifth embodiment of this invention for improving the limp-hole drivability in the bypass control will be explained with reference to FIG. 4.

Incidentally, the structure of the fifth embodiment of the invention is the same as that shown in FIG. 5. There is only a distinction between this embodiment and the example shown in FIG. 5 in part of the operation processing program within the first ECU 11.

In this case, the engine stall controlling means in the first ECU 11 is provided with a fuel interrupting means for interrupting the fuel supply to at least one of the cylinders of the engine 1 in the operation of the throttle power source interrupting means. Also, the fuel interrupting means is adapted to change the number of the cylinders which are to be the objects to which the fuel is not supplied.

Figure 4:
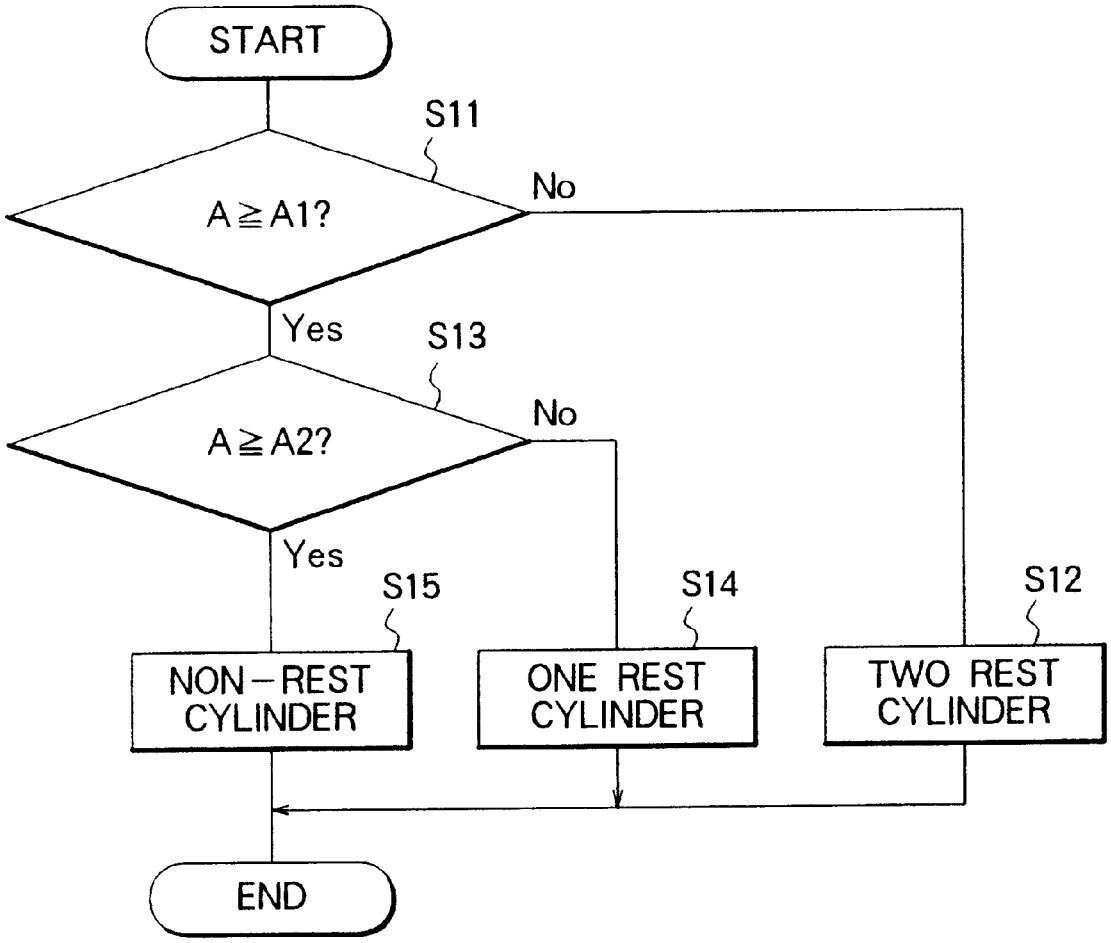
FIG. 4 is a timing chart for illustrating the fuel interrupting control operation in accordance with a fifth embodiment of the invention.

FIG. 4 is a timing chart showing the fuel interrupt control operation in accordance with the fifth embodiment of the invention, and showing the control operation in the case engine 1 has four cylinders.

In FIG. 4, first of all, the fuel interrupting means determines whether or not the accelerator opening degree signal A exhibits the level equal to or higher than a first predetermined level A1 (step S11).

If it is judged that the relationship of A<A1 is established (namely, NO), since it is recognized that the amount of the depression of the accelerator pedal 9 is relatively small and the output of the engine 1 is therefore also relatively small, the fuel supply to two cylinders out of the four cylinders is stopped. The two cylinders are at rest, and the drive condition is attained by the other two cylinders (step S12). The routine shown in FIG. 4 is finished.

On the other hand, in step S11, if the relationship of A≧A1 is established (i.e., YES), then the fuel interrupting means determines whether or not the accelerator opening degree signal A is equal to or higher than the predetermined level A2 (step S13).

In this case, the second predetermined level A2 is set at a level higher than the first predetermined level A1.

If the relationship of A<A2 is established (i.e., NO), it is recognized that the depression of the accelerator pedal 9 is in the middle position. Accordingly, the fuel supply to one out of four cylinders is stopped so that the one cylinder is kept at rest and the other three cylinders are kept in operation (step S14). The processing routine shown in FIG. 4 is finished.

On the other hand, in step S13, if the relationship of A≧A1 is established (i.e., YES), it is recognized that the depression of the accelerator pedal 9 is relatively large and relatively large output of the engine 1 is required. Accordingly, the fuel is supplied all four cylinders and none of the cylinders are at rest (step S15). The processing routine shown in FIG. 4 is finished.

Incidentally, as described above, in the case where the throttle valve 4 is fully opened or fixed in the vicinity of the fully opened condition (throttle open breakdown), even if the motor controlling relay 15 is turned off, the throttle valve 4 cannot be returned back to the fully closed condition, and the intake air amount signal Qa is not reduced. Accordingly, in this case, the shift to the bypass control is not effected.

Thus, the output of the engine 1 is reduced by stopping the cylinders so that the rest cylinder control may be performed in response to the accelerator opening degree signal A (the depression of the accelerator pedal 9). Even in the limp-home drive by the bypass control, it is possible to control drivability in response to the accelerator opening degree signal A by the driver's intention.

Incidentally, controlling the bypass intake air amount by interrupting the supply of fuel in this manner may be effective in particular for the case where an on/off valve is used as the bypass valve 8.

The reason for this is that, in the case where the control is shifted to the bypass control by using the bypass valve 8 composed of the on/off valve, since only the bypass valve 8 is turned on (opened) in the fully closed condition of the throttle valve 4, in the case where none of the cylinders are at rest under the control, only a constant amount of the bypass intake air amount for determining the fully opened degree of the bypass valve 8 is fed to the engine 1, and the control of drivability is disabled.

However, it is possible to use the inexpensive on/off valve as the bypass valve 8 by the above-described rest cylinder control.

Also, in FIG. 4, the number of the rest cylinders is switched over to the two cylinders or one cylinder but it is possible to switch the number of the rest cylinders as desired. It is possible to switch the number of the rest cylinders to three or more depending upon the total number of the cylinders of the engine 1 or to one only.

Embodiment 6

Furthermore, in the fifth embodiment, the number of the rest cylinders is switched over only in response to the accelerator opening degree signal A, but the number of the rest cylinders may instead be switched over on the basis of the engine RPM information from the RPM sensor.

For instance, in the case where the throttle valve 4 is broken down in the open condition, the control cannot be shifted to the bypass control even if the motor controlling relay 15 is turned off. Therefore, even if the bypass valve 8 is not opened, the output of the engine 1 is not reduced. Accordingly, there is a possibility that the engine RPM would be increased abnormally.

Accordingly, in the case where the engine RPM information from the RPM sensor indicates the level equal to or higher than a predetermined RPM, the fuel interrupting means performs the control to increase the number of the rest cylinders and prevent the abnormal increase of the engine RPM.

If such a rest cylinder control on the basis of the engine RPM is used together with the rest cylinder control in response to the accelerator opening degree signal A, it is possible to perform the output control of the engine 1 with high precision and it is possible to further enhance the limp-home drivability.

Embodiment 7

Furthermore, in the fifth embodiment, the number of the rest cylinders is switched over to the two cylinders or one cylinder in response to the comparison result between a first predetermined level A1 and a second predetermined level A2, however it is possible to switch the number of the rest cylinders alternatively in every fuel supply timing to thereby finely set the control precision of the drivability.

In this case, the fuel interrupting means sets a third predetermined level that is lower than the first predetermined level as the determination reference of the number of the cylinders to which the fuel is not supplied, and at the same time, sets a fourth predetermined level that is intermediate between the first predetermined level and the second predetermined level to repeatedly execute the comparison determination process between the accelerator opening degree signal A and the respective predetermined levels corresponding to every predetermined level.

Namely, in the case where the accelerator opening degree signal A is equal to or more than the fourth predetermined level and smaller than the second predetermined level A2, the fuel interrupting means performs alternatively the stop control of fuel supply to one cylinder (one rest cylinder) and the control not to stop the fuel supply (zero rest cylinder).

Also, in the case where the accelerator opening degree signal A is equal to or more than the third predetermined level and smaller than the first predetermined level A1, the fuel interrupting means performs alternatively the stop control of fuel supply to one cylinder (one rest cylinder) and the stop control of fuel supply to two cylinders (two rest cylinder).

Thus, the control condition corresponding to one between the one rest cylinder and the zero rest cylinder and the control condition corresponding to one between the two rest cylinder and the one rest cylinder are set so that the output of the engine 1 may finely be controlled to further enhance and stabilize the limp-home drivability.

Also, the frequency of the intermittent control of the fuel supply is changed to thereby further finely control the output of the engine 1.

For example, the two rest cylinder control is twice performed at the two ignition timings and thereafter, the one rest cylinder control is thrice performed at the three ignition timings to thereby more finely perform the control of the output of the engine 1.

Embodiment 8

Also, in the fifth and sixth embodiments, the fuel supply interrupting control which is effective in the case where the on/off valve is used as the bypass valve 8 has been described but in the case where a linear solenoid valve is used as the bypass valve 8, it is possible to perform a duty control of the bypass valve 8 in response to the accelerator opening degree signal A in the bypass controlling.

The duty drive is thus performed by using the linear solenoid valve so that the opening degree of the bypass valve 8 in the bypass control may be controlled with relatively high precision in response to the accelerator opening degree signal A (step-in amount of the accelerator pedal 9).

Accordingly, it is possible to enhance the limp-home drivability by the intake air amount control to which the driver's intention is reflected, and also, if the above-described rest cylinder control is combined therewith, it is further enhance the drivability.

Also, if the thus described duty control of the bypass valve 8 is combined with the above-described rest cylinder control, it is possible to realize the high precision engine output control to thereby further enhance the drivability.

Embodiment 9

Incidentally, in the above-described embodiments 1 to 8, the reduction change rate of the intake air amount signal Qa or the voltage level of the intake air amount signal Qa is used as the shift condition to the bypass control but any other sensor information may be used.

It is possible to take into consideration, for example, a vehicle velocity, an engine RPM, a charge efficiency, an intake pipe pressure or the like as the engine control information other than the intake air amount.

Accordingly, in this case, the variety of sensors include at least one of the vehicle velocity sensor for detecting the vehicle velocity, the RPM sensor for detecting the engine RPM, and the pressure sensor for detecting the pressure within the intake pipe of the engine.

Also, when at least one of the vehicle velocity, the RPM and the pressure is reduced to a level equal to or less than a predetermined value (the fully closed detection value of the throttle valve), the predetermined operational condition detecting means detects the predetermined operational condition.

Thus, also, by detecting the predetermined operational condition on the basis of the variety of sensor information and shifting to the bypass control, needless to say, it is possible to ensure the above-described effect in the same manner.

Embodiment 10

Further, in the embodiments 1 to 9, the shift condition to the bypass control is the fixed value but it is possible to use a variable as that in response to the operational condition in detecting the breakdown.

For instance, the predetermined amount Qr to be compared with the intake air amount signal Qa is high at an initial value in the case where the engine RPM is high in detecting the breakdown. Accordingly, the more the engine RPM, the higher the predetermined amount Qr will be set.

The shift condition to the predetermined operational condition in response to the operational condition is suitably set so that the reliability of the shift to the bypass control is enhanced and the limp-home drivability may be further enhanced.

Various details of the invention may be changed without departing from its spirit nor its scope. Furthermore, the foregoing description of the embodiments according to the present invention is provided for the purpose of illustration only, and not for the purpose of limiting the invention as defined by the appended claims and their equivalents.

What we claim is:

1. An engine controlling apparatus for an automotive vehicle, comprising:

an engine mounted on the vehicle and composed of a plurality of cylinders;

a variety of sensors for detecting an operational condition of said engine;

an engine controlling means for controlling said engine in response to the operational condition;

a throttle valve for adjusting an amount of intake air to be fed to said engine;

a throttle actuator for driving said throttle valve;

a throttle opening degree sensor for detecting an open/closed position of said throttle valve as a throttle opening degree;

a bypass passage for feeding air to said engine through a bypass around said throttle valve;

a bypass valve for opening/closing said bypass passage;

a bypass controlling means for controlling said bypass valve;

an accelerator opening degree sensor for detecting an operational position of an accelerator pedal as an accelerator opening degree;

a throttle controlling means for controlling said throttle actuator in response to said accelerator opening degree;

a breakdown detecting means for detecting a break down in a throttle controlling system including said throttle valve and said throttle opening degree sensor;

a throttle power source interrupting means for interrupting a power source supply to said throttle actuator in the case where the breakdown in the throttle controlling system is detected; and a predetermined operational condition detecting means for detecting a shift of said operational condition to a predetermined operational condition corresponding to a fully closed condition of said throttle valve in operation of said throttle power source interrupting means;

wherein said bypass controlling means opens said bypass valve to thereby feed the air to said engine at the time when the predetermined operational condition is detected in operation of said throttle power source interrupting means.

2. The engine controlling apparatus according to claim 1, further comprising an engine stall detecting means for detecting a stall condition of said engine;

wherein said bypass controlling means opens said bypass passage in the case where said engine is at a standstill in operation of said throttle power source interrupting means.

3. The engine controlling apparatus according to claim 1, wherein said engine controlling means comprises a fuel interrupting means for interrupting a fuel supply to at least one of the cylinders of said engine in operation of said throttle power source interrupting means.

4. The engine controlling apparatus according to claim 3, wherein said fuel interrupting-means changes the number of the cylinders to which the fuel supply is stopped in response to the accelerator opening degree.

5. The engine controlling apparatus according to claim 3, wherein said variety of sensors include an RPM sensor for detecting an RPM of said engine; and wherein said fuel interrupting means changes the number of the cylinders to which the fuel supply is stopped in response to the engine RPM.

6. The engine controlling apparatus according to claim 4, wherein said fuel interrupting means sets a first predetermined level corresponding to the accelerator opening degree as a judgement reference of the number of the cylinders to which the fuel supply is stopped and a second predetermined level that is higher than the first predetermined level;

stops the fuel supply to the two cylinders in the case where the accelerator opening degree is smaller than the first predetermined level;

stops the fuel supply corresponding to the one cylinder in the case where the accelerator opening degree is equal to or more than the first predetermined level and smaller than the second predetermined level; and does not stop the fuel supply corresponding to all the cylinders in the case where the accelerator opening degree is higher than the second predetermined level.

7. The engine controlling apparatus according to claim 6, wherein said fuel interrupting means sets a third predetermined level that is smaller than the first predetermined level as a judgement reference of the number of the cylinders to which the fuel supply is stopped and a fourth predetermined level that is intermediate between the first predetermined level and the second predetermined level;

performs alternatively a stop control of the fuel supply and a non-stop control of the fuel supply to one cylinder at every fuel supply timing in the case where the accelerator opening degree is equal to or more than the fourth predetermined level and smaller than the second predetermined level; and performs alternatively the stop control of the fuel supply to one cylinder and a stop control of the fuel supply to the two cylinders at every fuel supply timing in the case where the accelerator opening degree is equal to or more than the third predetermined level and smaller than the first predetermined level.

8. The engine controlling apparatus according to claim 3, wherein said bypass valve is composed of an on/off valve.

9. The engine controlling apparatus according to claim 1, wherein said bypass valve is composed of a linear solenoid valve and is duty driven in response to the accelerator opening degree in operation of said throttle power source interrupting means.

10. The engine controlling apparatus according to claim 1, wherein said predetermined operational condition detecting means sets variably a condition for detecting a shift to the predetermined operational condition in response to the operational condition in detecting the breakdown in the throttle controlling system.

11. The engine controlling apparatus according to claim 1, wherein:

said variety of sensors include an air flow sensor for detecting the amount of intake air; and said predetermined operational condition detecting means detects said predetermined operational condition when the amount of intake air is equal to or less than a predetermined level for detecting the fully closed condition of said throttle valve.

12. The engine controlling apparatus according to claim 1, wherein:

said variety of sensors include an air flow sensor for detecting the amount of intake air; and said predetermined operational condition detecting means detects said predetermined operational condition when a reduction rate of the amount of intake air is equal to or more than a predetermined level for detecting the fully closed condition of said throttle valve.

13. The engine controlling apparatus according to claim 1, wherein:

said variety of sensors include at least one of a vehicle velocity sensor for detecting a vehicle velocity of the vehicle, an RPM sensor for detecting an RPM of said engine, and a pressure sensor for detecting a pressure within the intake pipe of said engine; and said predetermined operational condition detecting means detects said predetermined operational condition when at least one of the vehicle velocity, the RPM and the pressure is equal to or less than a predetermined level for detecting the fully closed condition of said throttle valve.

14. The engine controlling apparatus according to claim 1, wherein said bypass controlling means does not open said bypass valve to thereby feed the air to said engine at the time when the predetermined operational condition is not detected in operation of said throttle power source interrupting means.

* * * * *